US011639561B2

(12) United States Patent
Cheng et al.

(10) Patent No.: US 11,639,561 B2
(45) Date of Patent: May 2, 2023

(54) METHOD FOR PREPARING CONTINUOUS BAMBOO FIBERS

(71) Applicant: International Center for Bamboo and Rattan, Beijing (CN)

(72) Inventors: Haitao Cheng, Beijing (CN); Mingpeng Li, Beijing (CN); Ge Wang, Beijing (CN); Wenfu Zhang, Beijing (CN); Shaohua Gu, Beijing (CN)

(73) Assignee: International Center for Bamboo and Rattan, Beijing (CN)

( * ) Notice: Subject to any disclaimer, the term of this patent is extended or adjusted under 35 U.S.C. 154(b) by 7 days.

(21) Appl. No.: 17/142,111

(22) Filed: Jan. 5, 2021

(65) Prior Publication Data

US 2021/0363662 A1 Nov. 25, 2021

(30) Foreign Application Priority Data

May 19, 2020 (CN) ..... 202010424890.4
Jun. 17, 2020 (CN) ..... 202010554369.2
(Continued)

(51) Int. Cl.
*D01B 1/50* (2006.01)
*D01B 1/22* (2006.01)

(52) U.S. Cl.
CPC ..... *D01B 1/50* (2013.01); *D01B 1/22* (2013.01)

(58) Field of Classification Search
CPC ... D01B 1/10; D01B 1/14; D01B 1/50; D01B 9/00; D01B 1/20; D01B 1/22
(Continued)

(56) References Cited

U.S. PATENT DOCUMENTS 5,397,067 A * 3/1995 Akiyama ..... D01B 1/22 428/17
6,086,804 A * 7/2000 Akiyama ..... D01B 1/10 241/20
(Continued)

FOREIGN PATENT DOCUMENTS

CN 108453850 A * 8/2018 ..... D01B 1/10
CN 110004575 A * 7/2019 ..... D04B 1/104
JP 2000071209 A * 3/2000 ..... D01B 1/10

*Primary Examiner* — Khoa D Huynh
*Assistant Examiner* — Aiying Zhao
(74) *Attorney, Agent, or Firm* — Jordan IP Law, LLC; Todd A. Vaughn

(57) ABSTRACT

A method for preparing continuous bamboo fibers, which relates to a technical field of bamboo fiber preparation. The method includes processing bamboo raw materials into reticulated bamboo fiber strips, screening the bamboo fiber strips, dividing the reticulated bamboo fiber strips with different properties according to product requirements, performing high pressure splitting on the reticulated bamboo fiber strips which conforms to a screening condition, separating the bamboo fibers with different slenderness ratios from the bamboo fiber strips after the high pressure splitting is performed, forming a partial oriented bamboo fiber mat with uniform density by the bamboo fibers, forming an oriented bamboo fiber bundle with uniform linear density by the bamboo fiber mat, twisting the bamboo fiber bundle to form a bamboo fiber yarn, forming a rope by the bamboo fiber yarn, and forming a spindle based on a specifications.

11 Claims, 11 Drawing Sheets

(30) Foreign Application Priority Data

Jul. 20, 2020 (CN) ..... 202010697224.8
Jul. 20, 2020 (CN) ..... 202010697447.4

(58) Field of Classification Search
USPC ..... 19/1, 5 R, 10, 24
See application file for complete search history.

(56) References Cited

U.S. PATENT DOCUMENTS

| | | | | |
|---|---|---|---|---|
| 10,266,987 | B2 * | 4/2019 | Slaven, Jr. | D21B 1/061 |
| 10,882,048 | B2 * | 1/2021 | Slaven, Jr. | D21B 1/066 |
| 2006/0059884 | A1 * | 3/2006 | Zhou | D01C 1/02 57/252 |
| 2007/0267159 | A1 * | 11/2007 | Zhao | D01B 1/50 162/25 |
| 2014/0000761 | A1 * | 1/2014 | Peng | D01C 1/00 144/3.1 |
| 2019/0054649 | A1 * | 2/2019 | Yao | B27J 1/00 |

* cited by examiner

METHOD FOR PREPARING CONTINUOUS BAMBOO FIBERS

CROSS REFERENCE TO RELATED APPLICATIONS

The present application claims priority to Chinese Patent Application Nos. 202010554369.2 filed (Jun. 17, 2020), 202010697224.8 (filed Jul. 20, 2020), 202010697447.4 (filed Jul. 20, 2020), and 202010424890.4 (filed May 19, 2020), each of which are hereby incorporated by reference in their complete respective entireties.

TECHNICAL FIELD

The application relates to a technical field of bamboo, kenaf, and palm fibers preparation, in particular, to a method for preparing continuous bamboo fibers.

BACKGROUND

There are more than 70 genera and 1,200 species of bamboo plants in the world, which mainly distributed in tropical and subtropical zones. A few bamboos are distributed in temperate and frigid zones. Area of world bamboo forest has reached 22 million hectares, accounting for about 1% of the area of forest. With the distribution and development of bamboo resources in various countries in the world, the bamboo industry has become a globally recognized green industry, which has huge economic, ecological and cultural values and is drawing increasing attention. As an important non-wood resource, under a background of nowadays global warming and wood shortage, research on the development of the bamboo industry has practical significance.

Bamboo fibers are natural plant fibers, which mainly have the following excellent properties: such as rich bamboo resources, high physical and mechanical strength, rapid moisture absorption and release, anti-bacteria and deodorizing. More importantly, bamboo fibers are renewable resources, which can be naturally biodegraded, and are useful for environmental protection. The bamboo fibers can be used in the fields of textiles, composite materials, building materials, environmental protection materials, packaging and the like. Furthermore, the bamboo fibers not only satisfy people's pursuit of new textiles and new materials, but also contribute to human and societal sustainable development, and thus has high social benefits and economic benefits.

The industrial preparation process for existing pure, continuous bamboo fiber has not yet been formed. By developing a complete processing equipment for continuous bamboo fibers and forming a continuous bamboo fiber preparation process, it can be realized that bamboo fibers are completely or partly substituted for bast fibers, glass fibers and chemical fibers and the like to be combined with resin so as to prepare prepreg in a form of filaments or ribbons being able to be wound and woven, which are then processed to obtain special-shaped structural preforms, and finally form plant fiber reinforced composite materials and their products. Thereby, such equipment and preparation process can promote the industrial structure adjustment and technological transformation and upgrading of bamboo fiber composite materials, and play a breakthrough effect in expanding the application of bamboo fiber composite products.

Therefore, it is desired to provide a new method for continuous bamboo fiber preparation to solve the above-mentioned problems in the prior art.

SUMMARY

The aim of the disclosure is to provide a method for preparing continuous bamboo fibers to solve the above-mentioned problems in the existing technology, reduce costs, and achieve large-scale and continuity of continuous bamboo fiber preparation.

In order to achieve the above-mentioned purpose, following solutions are providing according to the disclosure. A method for preparing continuous bamboo fibers is provided according to the disclosure, which include following steps:

step one: processing bamboo raw materials into bamboo fiber strips to form preliminary differentiated bamboo fibers.

step two: screening the bamboo fiber strips, and separating the bamboo fiber strips with different properties according to product requirements.

step three: performing high pressure splitting on the bamboo fiber strips which conform to a screening condition, to separate and form bamboo fibers and provide bamboo fiber raw materials for subsequent bamboo fiber products.

step four: separating the bamboo fibers with different slenderness ratios from the bamboo fiber strips after the high pressure splitting is performed.

step five: forming a partial oriented bamboo fiber mat with a uniform density by the bamboo fibers;

step six: forming an oriented bamboo fiber bundle with a uniform linear density by the bamboo fiber mat;

step seven: twisting the oriented bamboo fiber bundle to form a bamboo fiber yarn.

step eight: forming a rope by the bamboo fiber yarn; and step nine: winding the bamboo fiber yarn or the rope around a spindle based on a specification.

In some embodiments, in the step one, the bamboo fiber strips are reticulated bamboo fiber strips, which are processed by a reticulated bamboo fiber preparation unit.

In some embodiments, in the step one, three-year-old fresh neosinocalamus *affinis* may be selected, and the cylindrical neosinocalamus *affinis* may be cut into multiple sections by a machine, each of the multiple sections of neosinocalamus *affinis* may be cut into multiple pieces, each of the multiple pieces of neosinocalamus *affinis* may be processed by a high-efficiency reticulated bamboo fiber preparation machine to remove bamboo green and bamboo yellow, and rolled and loosened by smooth rollers and toothed rollers; and finally the reticulated bamboo fiber strips with specified length and width, criss-cross fibers and a thickness of 1-7 mm may be formed.

In some embodiments, in the step two, the bamboo fiber strips may be screened by a bamboo unit quality evaluation device according to an optical classification or a mechanical flexural modulus.

In some embodiments, in the step three, the bamboo fiber strips may be twisted to form fibrous bamboo sheets with specified length and width and a thickness of 1-5 mm, which may provide the bamboo fiber raw materials for the subsequent bamboo fiber products and a temperature of the bamboo fiber strips is adjusted to 20-75 degrees centigrade, and a humidity of the bamboo fiber strips may be adjusted to 10-80%.

In some embodiments, in the step four, the bamboo fiber raw materials with a thickness of 1-5 mm may be defibrated, and impurities and scraps may be removed, and the bamboo fiber raw materials may be separated into fluffy flocculent bamboo fibers with different slenderness ratios.

In some embodiments, in the step five, the fluffy flocculent bamboo fibers may be spread to form a continuous bamboo fiber mat with fibers distributed in a specified geometric shape, and the continuous bamboo fiber mat has specified density, width, and thickness.

In some embodiments, in the step six, the fiber mat is stretched and oriented to form a continuous bamboo fiber bundle with specified width and thickness by a bamboo fiber bundle directional stretching machine, wherein length directions of fibers of the fiber mat are all distributed in a conveying direction of the fibers.

In some embodiments, in the step seven, the continuous bamboo fiber bundle may be wound, drawn and twisted to form the bamboo fiber yarn with specified twist and diameter, and a diameter range of the bamboo fiber yarn may be 1.5-5 mm.

In the step eight, the bamboo fiber yarn may be plied and twisted to form the rope.

In some embodiments, in the step seven, fibers to be mixed may be added, and the bamboo fiber bundle and the fibers to be mixed may be mixed and twisted to form a mixed fiber yarn; the fibers to be mixed comprise natural fibers and/or chemical fibers.

Compared with the existing technology, the present embodiments have the following technical effects.

In the present embodiments, bamboos are used to replace some of hemps, glass fibers or the plastics, which are environmentally friendly, reduce cost and realize large-scale and continuity of the continuous bamboo fiber preparation.

BRIEF DESCRIPTION OF THE DRAWINGS

In order to more clearly illustrate the embodiments of the present disclosure or the technical solutions in the conventional art, drawings used in the embodiments will be briefly described below. It is apparent that the drawings in the following description are only some embodiments of the present disclosure, and those skilled in the art can obtain other drawings according to the drawings without creative efforts.

DETAILED DESCRIPTION

The technical solutions in the embodiments of the present disclosure will be clearly and completely described below with reference to the drawings in the embodiments of the present disclosure. It is apparent that the described embodiments are only a part of the embodiments of the present disclosure, and not all of the embodiments. All other embodiments, which can be obtained by a those skilled in the art without inventive effort based on the embodiments of the present disclosure, are within the scope of protection of the present disclosure.

In order to make the above-mentioned objects, features and advantages of the present disclosure more comprehensible, the present disclosure is described in detail with reference to the accompanying drawings and particular embodiments.

First Embodiment

A method for preparing continuous bamboo fibers is provided according to an embodiment, which includes the following steps.

In S1, the bamboo materials/sheets are processed into reticulated bamboo fiber strips.

Three-year-old fresh neosinocalamus *affinis* may be selected, and the neosinocalamus *affinis* is perforated by a punching machine or other methods to form a hollow cylindrical shape of neosinocalamus *affinis*; or the cylindrical bamboo is cut into a plurality of sections by a machine, and each of the plurality of sections of neosinocalamus *affinis* is cut into a plurality of pieces. Each of the plurality of pieces of neosinocalamus *affinis* is processed by a MZWX2030A high-efficiency reticulated bamboo fiber preparation machine or other reticulated bamboo fiber preparation machine that meet the needs of the work, to remove bamboo green and bamboo yellow thereof, and is rolled and loosened by several pairs of smooth rollers and toothed rollers, and finally the stable reticulated bamboo fiber strips with certain length and width, criss-cross fibers and a thickness of 4-7 mm (adjustable according to bamboo materials) are formed.

Figure 1:
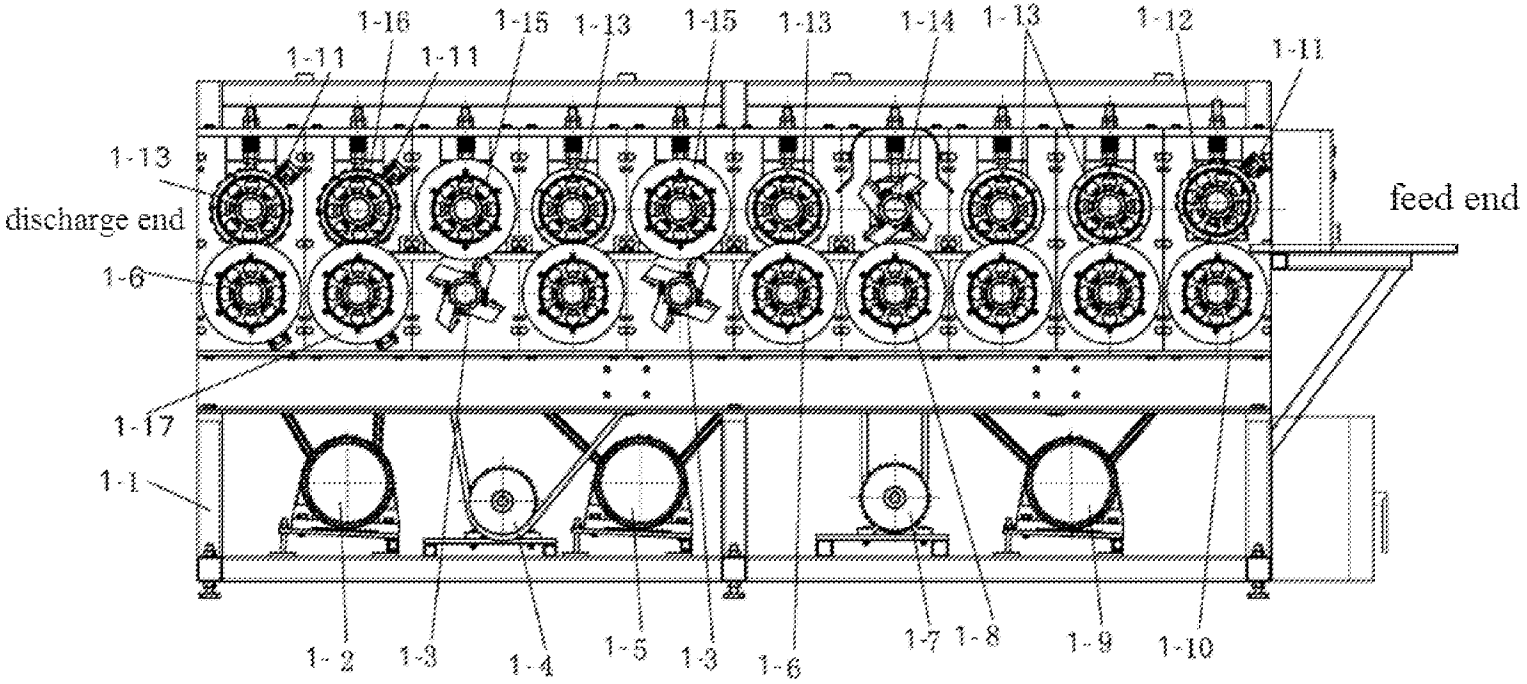
FIG. 1 is a schematic structural diagram of a reticulated bamboo fiber preparation machine according to the present disclosure.
Figure 2:
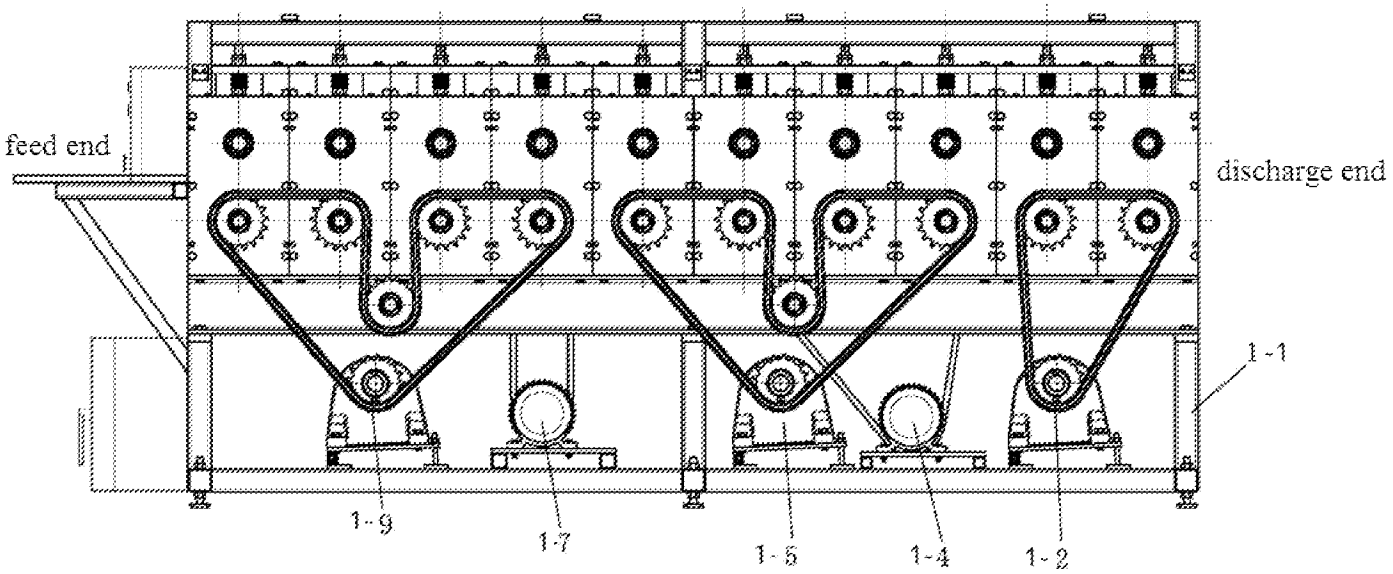
FIG. 2 is a top view schematic structural diagram of a reticulated bamboo fiber preparation machine according to the present disclosure.
Figure 3:
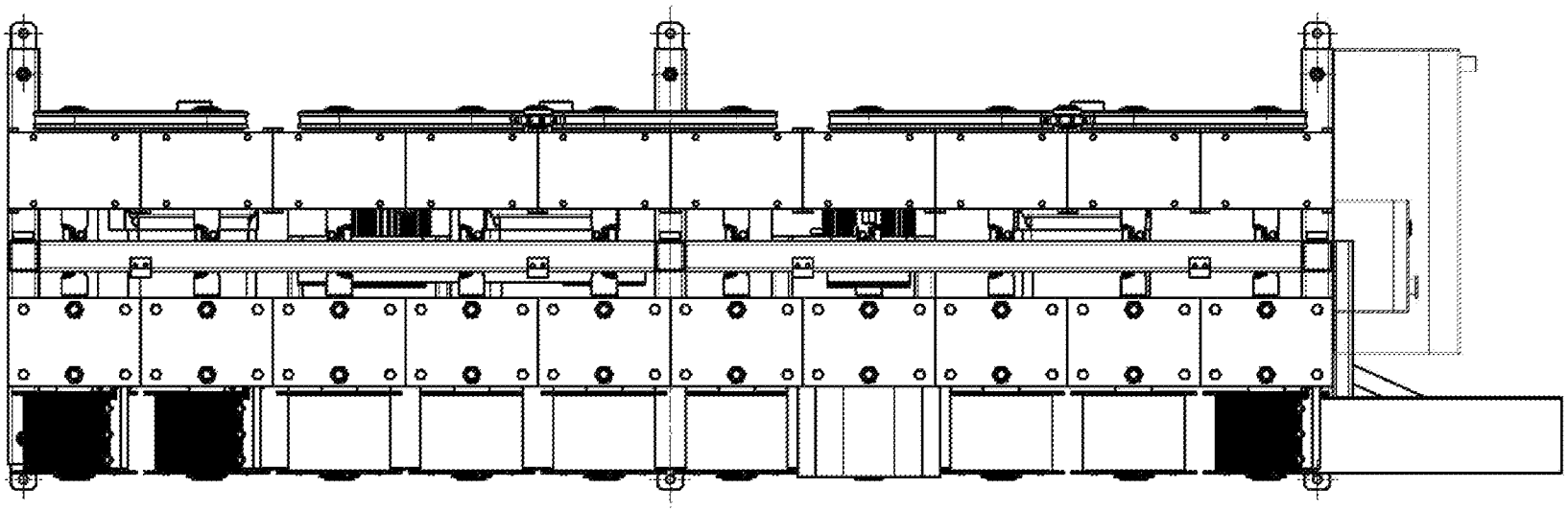
FIG. 3 is a rear view schematic structural diagram of a reticulated bamboo fiber preparation machine according to the present disclosure.
Figure 4:
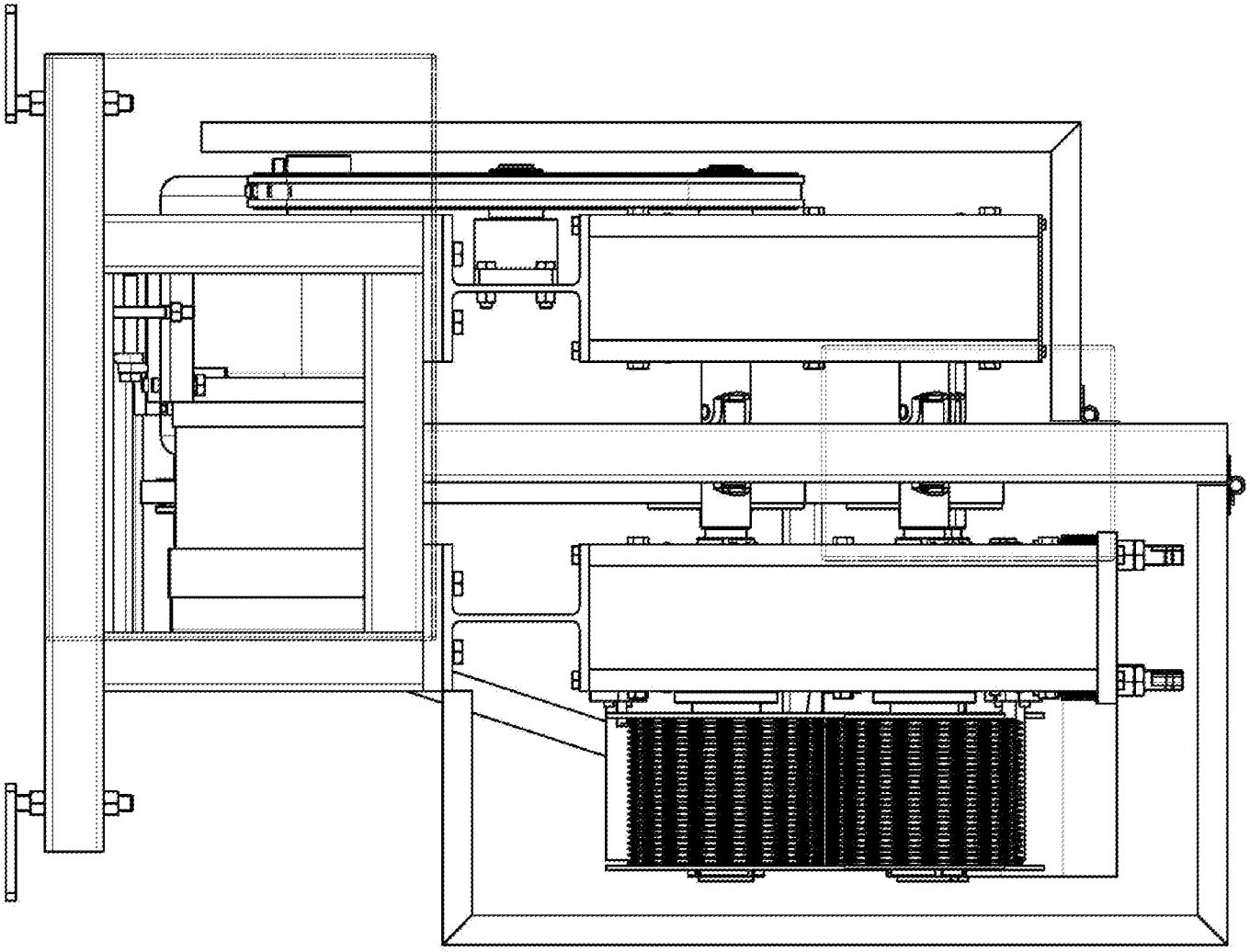
FIG. 4 is a side view schematic structural diagram of a reticulated bamboo fiber preparation machine according to the present disclosure.

As shown in FIGS. 1 to 4, the reticulated bamboo fiber preparation machine in this embodiment includes a frame 1-1, a knot removing roller assembly, a rolling roller assembly, a bamboo yellow removing roller assembly, a bamboo green removing roller assembly, and a loosening roller assembly, all of which are arranged on the frame 1-1.

The knot removing roller assembly, a first rolling roller assembly, a second rolling roller assembly, the bamboo yellow removing roller assembly, a third rolling roller assembly, a first bamboo green removing roller assembly, a fourth rolling roller assembly, a second bamboo green removing roller assembly, a first loosening roller assembly and a fifth rolling roller assembly are arranged on the frame 1-1 in sequence from a feed end to a discharge end.

The knot removing roller assembly includes a knot removing roller 1-12 and a knot removing driving wheel 1-10. The knot removing roller 1-12 is arranged directly above the knot removing driving wheel 1-10, and the knot removing driving wheel 1-10 is connected with a first rolling motor 1-9 by a roller chain.

The rolling roller assembly includes a rolling roller 1-13 and a rolling driving wheel 1-6. The rolling roller 1-13 is arranged directly above the rolling driving wheel 1-6, and the rolling driving wheel 1-6 is connected with a rolling motor 1-9 by a roller chain. [01] In this embodiment, five rolling roller assemblies are provided in total, in which the rolling driving wheels 1-6 of the first assembly and second rolling roller assembly are drivingly connected to the first rolling motor 1-9 by a roller chain; the rolling driving wheels 1-6 of the third assembly and fourth rolling roller assembly are drivingly connected to the second rolling motor 1-5 by a roller chain, and the rolling driving wheels 1-6 of the fifth rolling roller assembly are drivingly connected to the loosening motor 1-2 by a roller chain.

The bamboo yellow removing roller assembly includes a bamboo yellow removing roller 1-14 and a bamboo yellow removing driving wheel 1-8. The bamboo yellow removing roller 1-14 is arranged directly above the bamboo yellow removing driving wheel 1-8, a power connection is provided between the bamboo yellow removing roller 1-14 and a bamboo yellow removing motor 1-7, and the bamboo yellow removing driving wheel 1-8 is drivingly connected with the first rolling motor 1-9 by a roller chain.

A plurality of scrapers are uniformly arranged on the bamboo yellow removing roller 1-14 in a circumferential direction.

The bamboo green removing roller assembly includes a bamboo green removing roller 1-3 and a bamboo green removing driving wheel 1-15. The bamboo green removing roller 1-3 is arranged directly below the bamboo green removing driving wheel 1-15, a power connection is provided between the bamboo green removing roller 1-3 and the second rolling motor 1-5, and the bamboo green removing driving wheel 1-15 is drivingly connected with a bamboo green removing motor 1-4 by a triangle belt.

A plurality of scrapers are uniformly arranged on the bamboo green removing roller in a circumferential direction.

The loosening roller assembly includes a loosening roller 1-16 and a loosening driving wheel 1-17. The loosening roller 1-16 is arranged directly above the loosening driving wheel 1-17, and the loosening driving wheel 1-17 is drivingly connected with a loosening motor 1-2 by a roller chain.

Brushes 1-11 are arranged on an obliquely upper side of the knot removing roller 1-12, the loosening roller 1-16 and the fifth rolling roller 1-13, respectively. The knot removing roller 1-12, the loosening roller 1-16 and the fifth rolling roller 1-13 are cleaned by the brushes 1-11 to remove bamboo shavings.

Heights of the knot removing roller 1-12, five rolling rollers 1-13, the bamboo yellow removing roller 1-14 and two bamboo green removing driving wheels 1-15 are adjustable. Specifically, the knot removing roller 1-12, the five rolling rollers 1-13, the bamboo yellow removing roller 1-14 and the two bamboo green removing driving wheels 1-15 are all arranged on the frame 1-1 through a height adjusting mechanism. The height adjusting mechanism includes a screw, a spring, an upper nut and a lower nut. The bottom of the screw is connected to the central axes of the knot removing roller 1-12, the five rolling rollers 1-13, the bamboo yellow removing roller 1-14 and the two bamboo green removing driving wheels 1-15. The spring is sheathed on the screw, the lower nut is arranged at a lower part of the spring, and the upper nut is arranged between the upper part of the screw and the frame 1-1. A height of the screw relative to the frame 1-1 is adjust by adjusting positions of the upper nut and the lower nut on the screw, so as to change the heights of the knot removing roller 1-12, the five rolling rollers 1-13, the bamboo yellow removing roller 1-14 and the two bamboo green removing driving wheels 1-15.

In use, an original bamboo sheet is fed from the inlet end, and the inside of original bamboo sheet is upwards. The bamboo knots on the inside of the original bamboo sheet are removed by the knot removing roller 1-12. Then, a first rolling and a second rolling is performed on the original bamboo sheet, to make the structure thereof more compact and facilitate subsequent processing. When the original bamboo sheet after rolling passes through the bamboo yellow removing roller assembly, the yellow on an inner surface of the original bamboo sheet are scraped off by four scrapers on the bamboo yellow removing roller 1-14. Then, the third time the original bamboo sheet are rolled. The original bamboo sheet after the third time rolling enters the first group of bamboo green removing component. The bamboo green on the outer side of the original bamboo sheet is scraped off by four scrapers on the first bamboo green removing roller 1-3 below the original bamboo sheet. After the fourth time rolling, the original bamboo sheet enters the second group of the bamboo green removing component. The remaining bamboo green on the outer side of the original bamboo sheet is scraped off by four scrapers on the second bamboo green removing roller 1-3 below the original bamboo sheet. Then, the original bamboo sheet is loosened by the loosening roller 1-16 and rolled for the fifth time to obtain the reticulated bamboo fiber strips discharged from the discharge end.

In S2, the bamboo fiber strips are screened.

The reticulated bamboo fiber strips are subjected to optical classification and mechanical flexural modulus online evaluation by a bamboo unit quality evaluation device, to obtain the reticulated bamboo fiber strips with different properties according to product requirements.

The optical classification is determined according to a chromatic aberration value ΔE*, where its parameters are L, a, b, and a calculation formula is as follows:

$$\Delta E^* = [(\Delta L^{*2} + (\Delta a^*)^2 + (\Delta b^*)^2]^{1/2}$$

where ΔL* is a brightness axis, which means black and white, wherein 0 is black and 100 is white, Δa* is a red-green axis, wherein a positive value indicates red, a negative value indicates green and 0 indicates a neutral color, Δb* is a yellow-blue axis, wherein a positive value indicates yellow, a negative value indicates blue, and 0 indicates a neutral color, ΔE* is defined as a total chromatic aberration of a sample. The larger the value, the greater the chromatic aberration. Generally, ΔE* is visually distinguishable at 1.5.

(the reticulated bamboo fiber strips are separated into I, II . . . , according to the ΔE* thereof).

The mechanical flexural modulus is to apply a constant pressure to the reticulated bamboo fiber strips to realize a performance test of the reticulated bamboo fiber strips. In this way, the reticulated bamboo fiber strips can be accurately classified, and unqualified products with mechanical defects can be found.

Chromatic aberration is generally separated into 6 levels: no chromatic aberration when ΔE* is less than or equal to 1.5; very slight when ΔE* is larger than 1.5 and less than or equal to 3; slight when ΔE* is larger than 3 and less than or equal to 6; obvious when ΔE* is larger than 6 and less than or equal to 9; greater when ΔE* is larger than 9 and less than or equal to 12 and severe when ΔE* is larger than 12.

A measuring range of mechanical modulus is 0-5 Gpa, and its accuracy is 0.1%, which can accurately and quickly identify defective feed materials.

Figure 5:
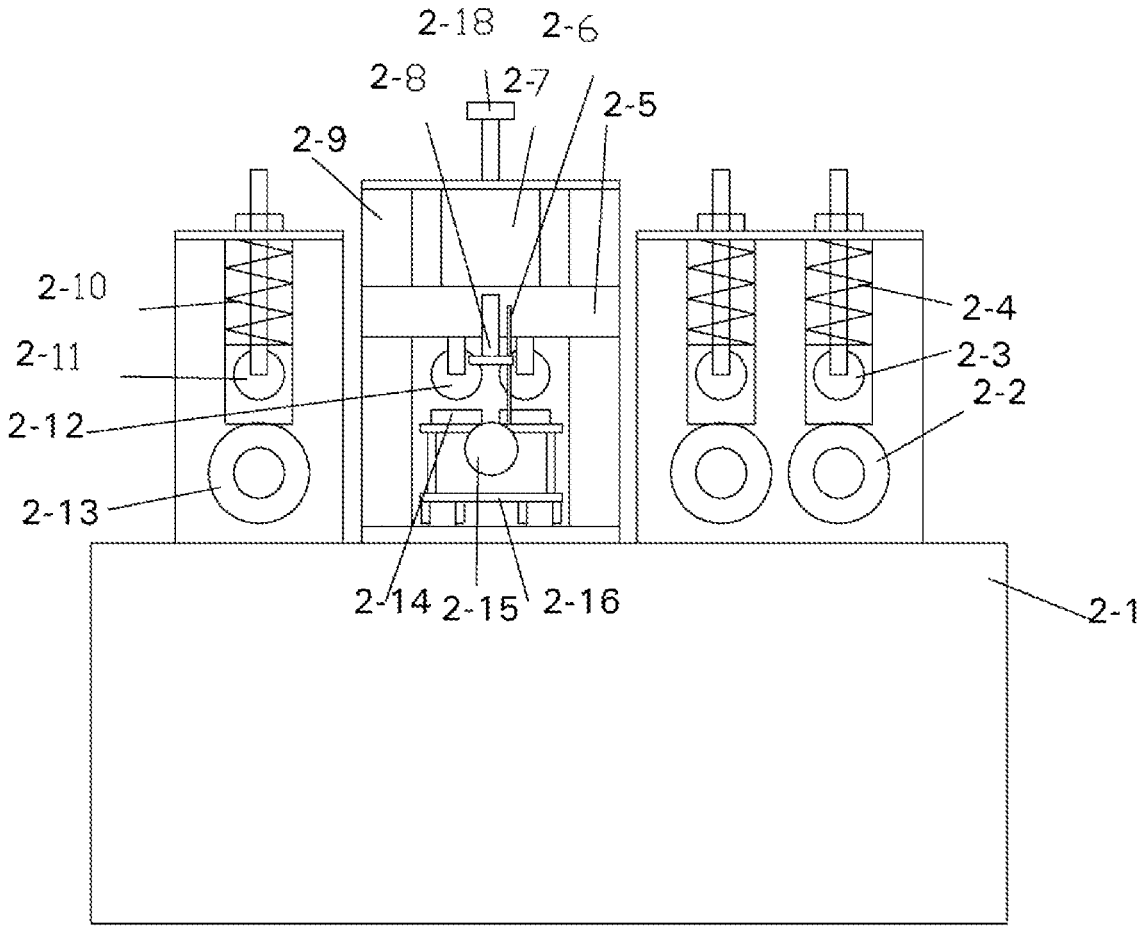
FIG. 5 is a schematic structural diagram of a bamboo unit quality evaluation device according to the present disclosure.
Figure 6:
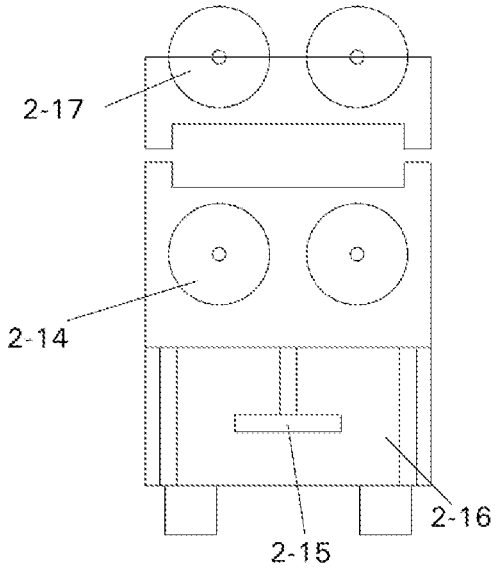
FIG. 6 is a schematic structural diagram of a guide assembly of a bamboo unit quality evaluation device according to the present disclosure.
Figure 7:
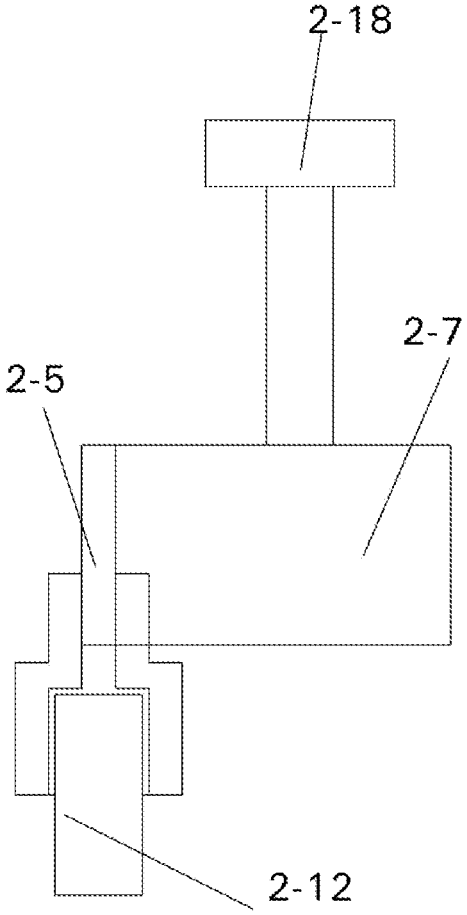
FIG. 7 is a schematic structural diagram of a test pressing wheel of a bamboo unit quality evaluation device according to the present disclosure.
Figure 8:
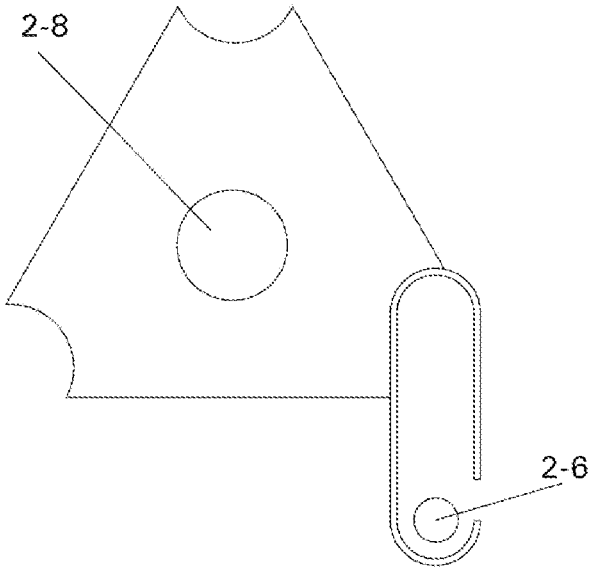
FIG. 8 is a schematic structural diagram of a pressure sensor of a bamboo unit quality evaluation device according to the present disclosure.
Figure 9:
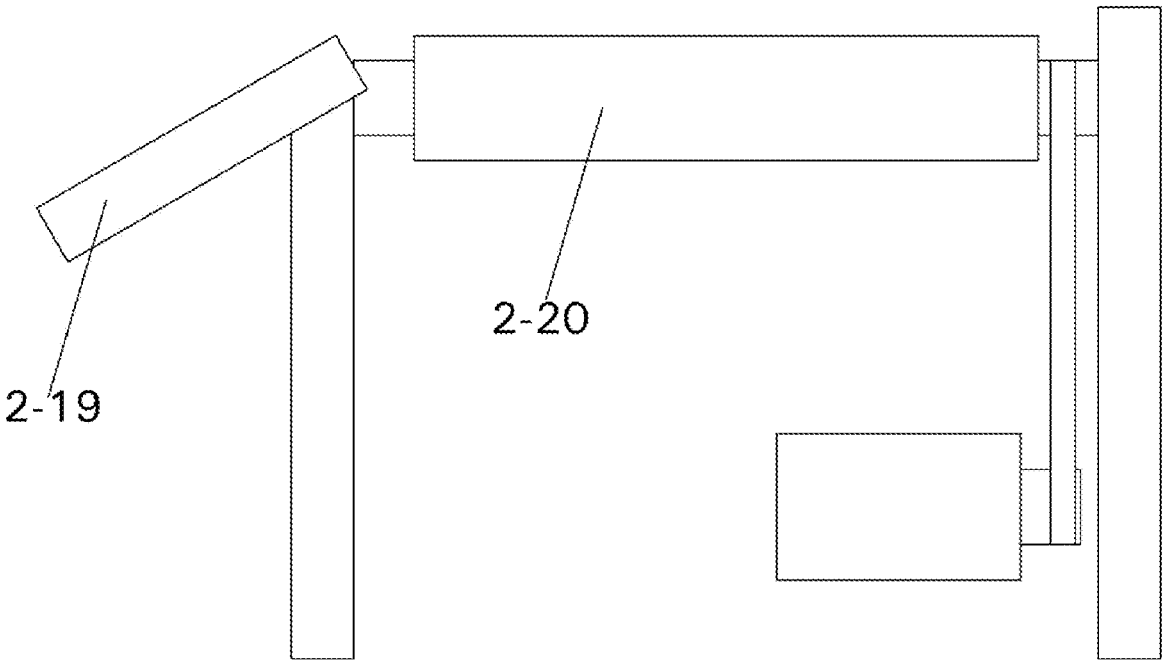
FIG. 9 is a schematic structural diagram of a sorting frame of a bamboo unit quality evaluation device according to the present disclosure.
Figure 10:
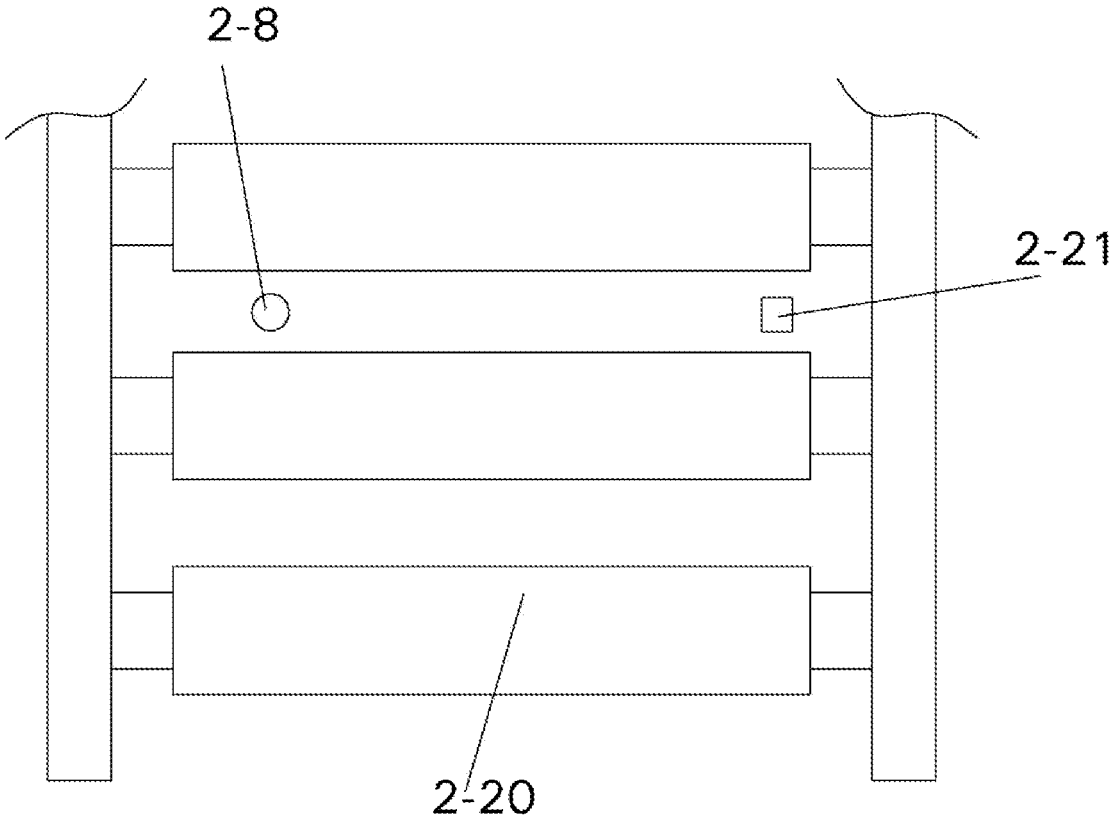
FIG. 10 is a top view schematic structural diagram of a sorting frame of a bamboo unit quality evaluation device according to the present disclosure.

In an embodiment, as shown in FIGS. 5-10, the bamboo unit quality evaluation device includes a host machine and a sorting frame. The host machine includes a frame 2-1, and an inlet driving mechanism, a mechanical testing mechanism, and an outlet driving mechanism are arranged on the frame 2-1. A plurality of the sorting frames are provided at an outlet side of the host machine along a straight line. A power connection is provided between the inlet driving mechanism and a power source, and between the outlet driving mechanism and a power source.

The inlet driving mechanism includes an inlet bracket, an inlet pressing roller 2-3 and an inlet driving roller 2-2. The inlet pressing roller 2-3 is movably arranged on the inlet bracket. The inlet driving roller 2-2 is arranged directly below the inlet pressing roller 2-3. A power connection is provided between the inlet driving roller 2-2 and a power source.

A vertical screw is arranged at each end of a central axis of the inlet pressing roller 2-3, and the screw is removable connected with the inlet bracket. A first spring 2-4 and a first slider are arranged between the inlet bracket and the central axis of the inlet pressing roller 2-3. The first slider is located under the first spring 2-4, and the first slider is slidably connected with the inlet bracket. The bamboo sheet is inserted between the inlet pressing roller 2-3 and the inlet driving roller 2-2, and moved forward under the driving of the inlet driving rollers 2-2. The inlet pressing rollers 2-3 apply pressure on the bamboo sheet under the action of the first spring 2-4 to ensure that the bamboo sheet can get sufficient driving force.

The inlet driving mechanism includes two inlet pressing rollers 2-3 arranged in parallel and two inlet driving rollers 2-2 arranged in parallel. A power connection is provided between the two inlet driving rollers 2-2 and one power source. The outlet driving mechanism includes an outlet bracket, an outlet pressing roller 2-11 and an outlet driving roller 2-13. The outlet pressing roller 2-11 is movably arranged on the outlet bracket. The outlet driving roller 2-13 is arranged directly below the outlet pressing roller 2-11. A power connection is provided between the outlet driving roller 2-13 and a power source.

A vertical screw is arranged at each end of a central axis of the outlet pressing roller 2-11, and the screw is removable connected with the outlet bracket. A second spring 2-10 and a second slider are arranged on the screw, which are provided between the outlet bracket and the central axis of the outlet pressing roller 2-11. The second slider is located under the second spring 2-10, and the second slider is slidably connected with the outlet bracket.

The power source adopts a motor. A power output shaft of the motor is respectively connected to the inlet driving roller 2-2 and the outlet driving roller 2-13 by a chain, so that the rotation speeds of the inlet driving roller 2-2 and the outlet driving roller 2-13 are the same.

By adjusting the rotation speed of the motor, the screening rate can be adjusted within 0-10 m/s.

The mechanical testing mechanism includes two pillars 2-9 arranged in parallel in a middle of the frame 2-1. A support plate is arranged on the tops of the two pillars 2-9. A pressure sensor is arranged on the support plate. A cross beam 2-5 is slidably arranged between the two pillars 2-9; and two test pressing wheels 2-12 are arranged on the cross beam 2-5. A guide assembly is arranged below each of the test pressing wheels 2-12.

The cross beam 2-5 is slidably arranged on the two pillars 2-9 through a slider. The cross beam 2-5 is connected with a screw nut. The screw nut is sleeved on a screw rod. A handle 2-18 is provided at the top of the screw rod and is located above the support plate. By turning the handle 2-18, the screw nut drives the beam 2-5 to move on the pillars 2-9, thereby changing the height of the test pressing wheels 2-12.

A third spring is arranged between the screw nut and the support plate. When passing under the test pressing wheels 2-12, the bamboo sheet lifts up the test pressing wheels 2-12, and a pressure is applied to the bamboo sheet by the third spring. Since the bamboo sheet has a constant thickness, the pressure applied by the third spring is a test pressing of the mechanical flexural modulus of the bamboo sheet, and the pressure sensor transmits pressure data of the third spring to the signal collector 2-7.

The guide assembly includes a fixed guide wheel 2-17 and a movable guide wheel 2-14. The fixed guide wheel 2-17 is rotatably arranged under the two test pressing wheels 2-12 on the side facing the two pillars 2-9. The movable guide wheel 2-14 is rotatably arranged on an adjustment platform, and the adjustment platform is arranged on the frame 2-1. The adjustment platform is driven by a conventional screw rod and a screw nut, and the specific structure is not repeated. A distance between the movable guide wheel 2-14 and the fixed guide wheel 2-17 can be adjusted by the adjustment platform 2-16, so as to adapt to bamboo sheets with different widths.

A ruler 2-6 is arranged on the adjustment platform. A pointer is arranged on the optical probe 2-8, and the pointer is fixedly sleeved outside the optical probe. An end of the pointer is provided with an oblong hole, and the ruler 2-6 is movably sleeved in the oblong hole. The height of the test pressing wheels 2-12 can be preset by the scale on the ruler 2-6, that is, the pressure of the third spring on the bamboo sheet can be set.

The sorting frame includes multiple conveying rollers 2-20 arranged on a support. A power connection is provided between the conveying rollers and a driving mechanism. A sloping plate 2-19 is arranged on one side of the support. An optical probe 2-8 and a moving sheet 2-21 are arranged between the conveying rollers 2-20, the moving sheet 2-21 is connected to pneumatic clamp, and the optical probe 2-8 are electrically connected to the pneumatic clamp.

The optical probes 2-8 on multiple sorting frames are set with different chromatic aberration signals. When the bamboo sheet passes through the optical probes 2-8, the color of the bamboo sheet is determined to match the set chromatic aberration signal of an optical probe 2-8, and then the optical probe 2-8 sends a signal to start the pneumatic clamps to drive the moving sheet 2-21 to move along the axis of the conveying rollers 2-20, thereby pushing the bamboo sheet onto the sloping plate 2-19 and causing the bamboo sheet to fall from the sloping plate 2-19. In this way, the bamboo sheets with different chromatic aberrations can be separated.

Mechanical grade is to meet a grading optimization of structural materials and reconstituted materials in the market, and the chromatic aberration grade is to meet the needs of decoration, furniture, and flooring in the market that are sensitive to color differences. Materials that do not meet the mechanical grade will be collected in the designated sorting frame.

In S3, a high-pressure splitting may be performed on qualified bamboo fiber tapes. High-pressure splitting refers to applying a high pressure to the bamboo fiber tapes, and then squeezes or rolls the bamboo fiber tapes to differentiate them to realize a preliminary separation and formation of the fibers.

The reticulated bamboo fiber tapes of a certain geometric size, which conforms to a screening condition, are twisted to form a fibrous bamboo sheet with certain length and width and a thickness of 1-5 mm. The formed fibrous bamboo sheet can be used as bamboo fiber raw materials for subsequent bamboo fiber products. A temperature of the fibers is adjusted to 20-75 degrees centigrade and a humidity of the fibers is adjusted to 10-80%.

In S4, the bamboo fiber tapes performed high-pressure splitting is separated into the bamboo fibers with different slenderness ratios (refer to bamboo fiber standards).

The compact fiber tape raw materials with a thickness of 1-5 mm is defibrated, and impurities and scraps are removed, and the bamboo fiber tapes performed high-pressure splitting are separated into fluffy flocculent bamboo fibers with different slenderness ratios. The specific indicators are as follows:

| | | Fiber Type | | | |
|---|---|---|---|---|---|
| Item | Unit | I | II | III | IV |
| Bamboo fiber length | mm | >128 | 128-50 | 50-15 | <15 |
| Sample qualification rate[a] | % | 85 | 85 | 90 | 95 |
| Bamboo fiber fineness | μm | >200 | 200-150 | 150-50 | <50 |
| Bamboo fiber roughness | mg/m | >40 | 30-40 | 20-30 | <20 |

[a]indicates a percentage of the number of the bamboo fiber sample with a length satisfying the predetermined length interval in the total number of the bamboo fiber sample.

In S5, partial oriented bamboo fiber mat with a uniform density is formed by bamboo fibers.

The fluffy flocculent fiber materials are spread to form continuous fiber mats with fibers distributed in a certain geometric shape, and the continuous fiber mats have certain density, width, and thickness.

In S6, an oriented bamboo fiber bundle with a uniform linear density is formed by the bamboo fiber mat.

The fiber mat with a certain geometric size after fiber felting are stretched and oriented to form a continuous fiber bundle with specified width and thickness of the fibers by a bamboo fiber bundle directional stretching machine, wherein length directions of fibers of the fiber mat are all distributed in a conveying direction of the fibers.

The width of the bamboo fiber mat ranges from 1.5 mm to 5 mm.

Figure 11:
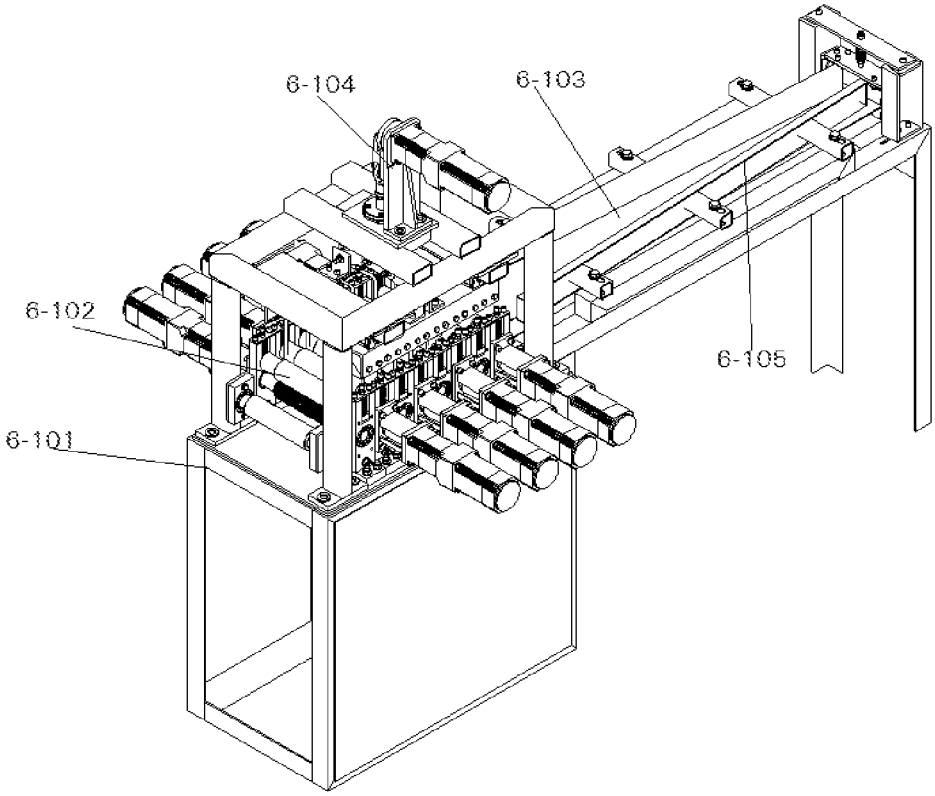
FIG. 11 is a three-dimensional schematic structural diagram of a bamboo fiber bundle directional stretching machine according to the present disclosure.
Figure 12:
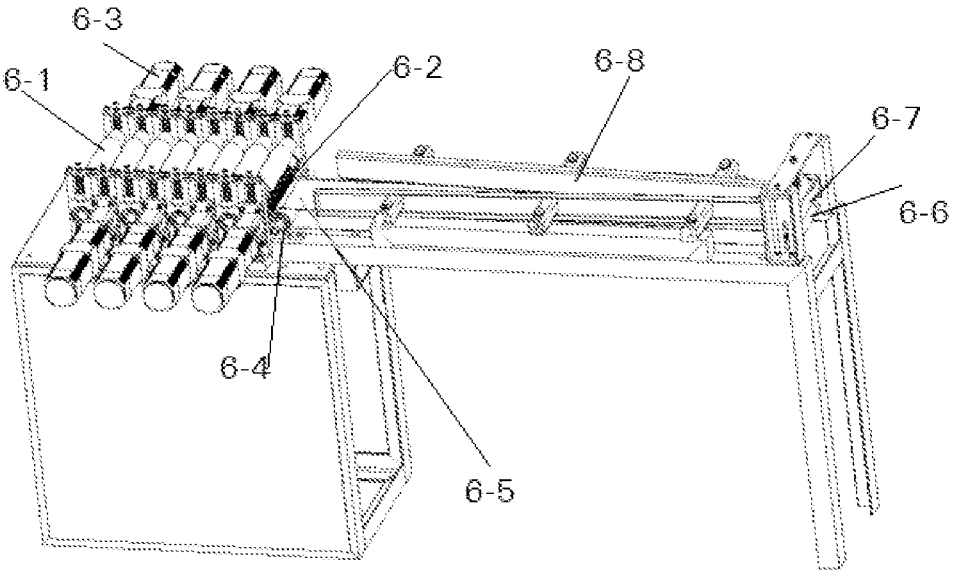
FIG. 12 is a three-dimensional schematic structural diagram of a bamboo fiber bundle directional stretching machine without a shooting assembly according to the present disclosure.
Figure 13:
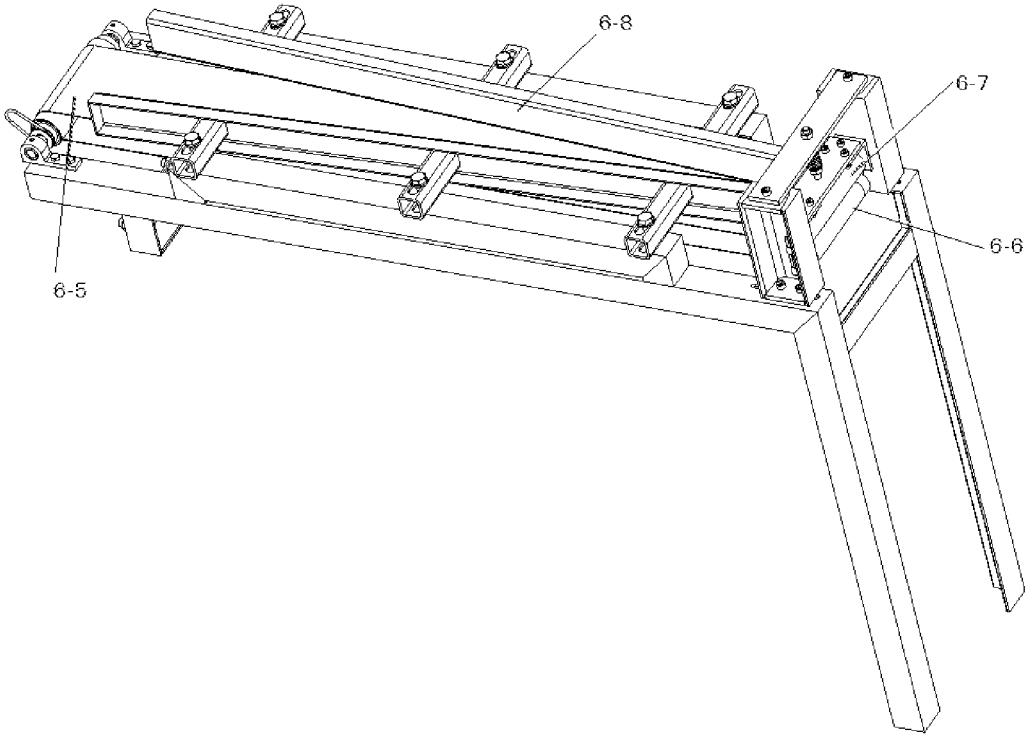
FIG. 13 is a three-dimensional schematic structural diagram of a discharge conveying assembly according to the present disclosure.
Figure 14:
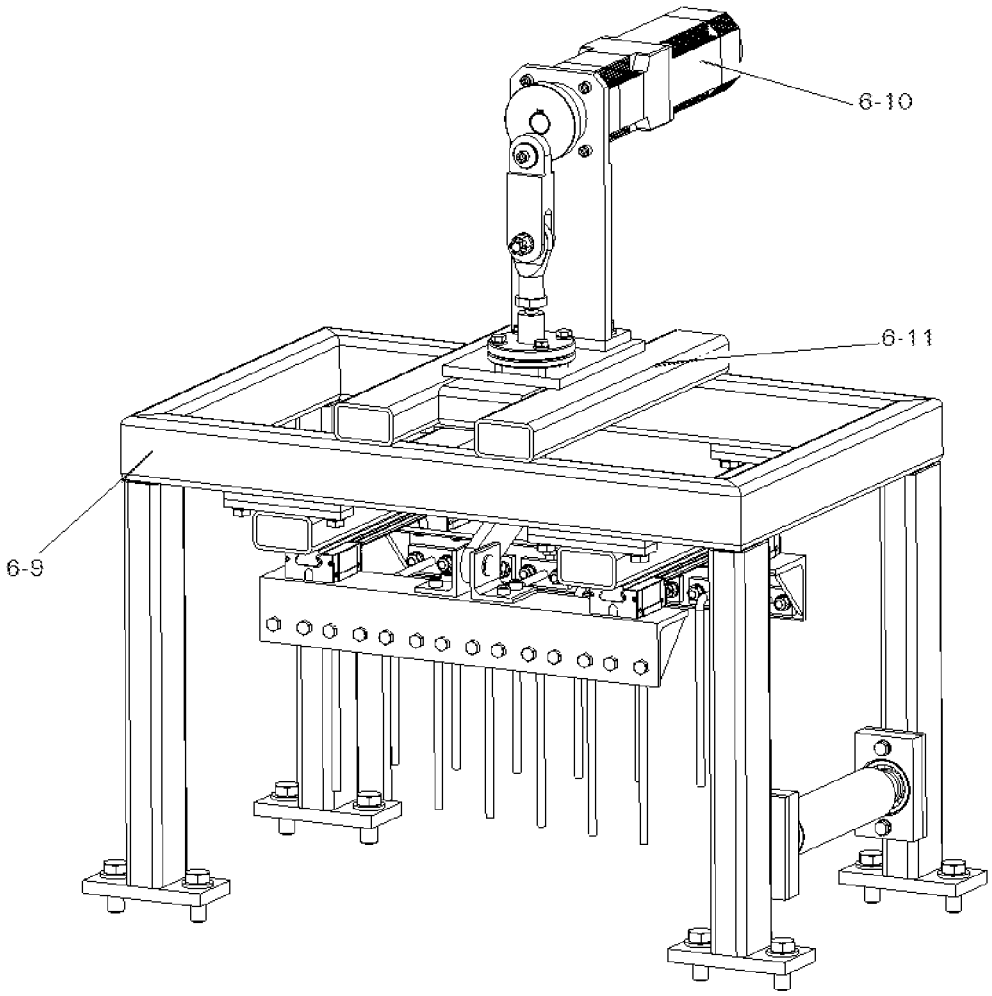
FIG. 14 is a three-dimensional schematic structural diagram of a shooting assembly according to the present disclosure.
Figure 15:
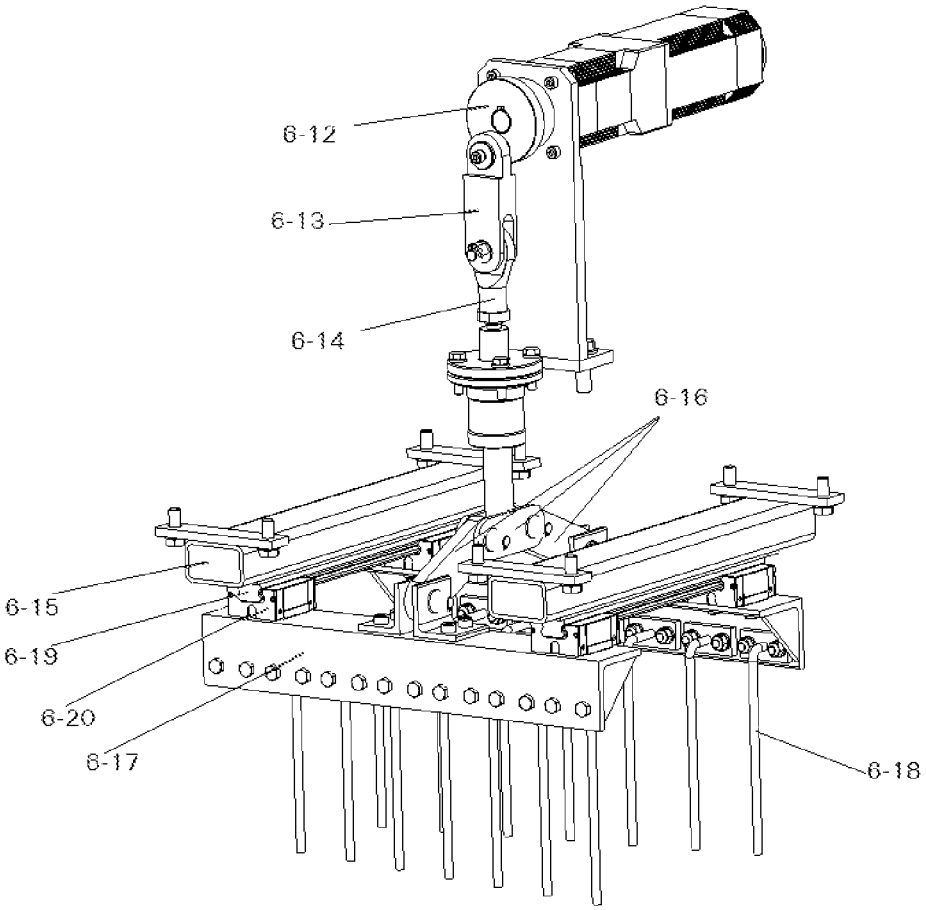
FIG. 15 is a three-dimensional schematic structural diagram of a shooting assembly without a shooting frame assembly according to the present disclosure.

As shown in FIGS. 11-15, the bamboo fiber bundle directional stretching machine in an embodiment includes a frame assembly 6-101, a roller assembly 6-102, a discharge conveying assembly 6-103 and a fiber bundle collapsing mechanism 6-105. The frame assembly 6-101 is supported on bottoms of the roller assembly 6-102 and the discharge conveying assembly 6-103. The roller assembly 6-102 includes multiple groups of roller assemblies arranged on a top of the frame assembly 6-101. Each group of the roller assemblies 6-102 includes an upper roller 6-1 and a lower roller 6-2 arranged opposite to each other. The upper roller 6-1 and the lower roller 6-2 are driven and rotated by a roller driving motor 6-3. The discharge conveying assembly 6-103 is arranged at the tail end of the roller assembly 6-102 and includes a first belt roller 6-4, a second belt roller 6-6 and a belt 6-5. The first belt roller 6-4 is arranged at the tail end of the roller assembly 6-102. The second belt roller 6-6 is arranged at a fiber bundle discharge port. The first belt roller 6-4 and the second belt roller 6-6 synchronously rotate through the belt 6-5. The lower roller 6-2 of a group of the roller assemblies 6-102 at the tail end drives the first belt roller 6-4 by the belt 6-5 to rotate. The fiber bundle collapsing mechanism 6-105 is arranged at a top of the discharge conveying assembly 6-103. The fiber bundle collapsing mechanism 6-105 includes two collapsing plates 6-8 which are gradually reduced in transverse distance from a feed direction to a discharge direction. The collapsing plates 6-8 are arranged on the frame assembly 6-101. A pressing roller 6-7 is provided on the top of the second belt roller 6-6. Specifically, the upper roller 6-1 is a long shaft with a smooth surface, and the lower roller 6-2 is a long shaft with grooves on the surface. The directional tract of the continuous fiber mat is realized by a texture of the roller itself and a speed difference between stages.

The bamboo fiber bundle directional stretching machine according to an embodiment further includes a shooting assembly 6-104. The shooting assembly includes a shooting frame assembly 6-9, a shooting driving motor 6-10, a shooting bracket 6-11, an eccentric wheel 6-12, a transmission connecting rod 6-13, a guide tube 6-14, a linear guide rail sub-assembly 6-15, a stroke connecting rod 6-16, shooting needle dials 6-17, shooting needles 6-18, a guide rail 6-19 and a slider 6-20. The shooting frame assembly 6-9 is arranged at a top of the frame assembly 6-101. The shooting bracket 6-11 is arranged at a top of the shooting frame assembly 6-9. The shooting driving motor 6-103 is fixed to a top of the shooting bracket 6-11 by a support plate. The eccentric wheel 6-12 is fixed on an output shaft of the shooting driving motor 6-10. The eccentric wheel 6-12 is connected to the transmission connecting rod 6-13 by an eccentric shaft. The guide pipe 6-14 is fixedly connected to a bottom of the transmission connecting rod 6-13. The guide pipe 6-14 is fixedly connected to a transverse stroke connecting rod 6-16. Each end of the stroke connecting rod 6-16 hinges to a stroke connecting rod 6-16 which tilts at 45 degrees. The two tilted stroke connecting rods 6-16 are symmetrically arranged. Each of end parts of two tilted stroke connecting rods 6-16 is respectively connected with one of the shooting needle dials 6-17; and the tilted stroke connecting rod 6-16 hinges to the top of the shooting needle dial 6-17. A slider 6-20 is fixed on each side of a top of each shooting needle dial 6-17. The sliders 6-20 on the tops of the two shooting needle dials 6-17 are opposite to each other. Two sliders 6-20 on the same side of the two shooting needle dials 6-17 share a same horizontally arranged guide rail 6-19. A sliding groove is arranged on each of the sliders 6-20 to be able to slidably connect with the guide rail 6-19. The linear guide rail sub-assembly 6-15 is fixedly connected to the guide rail 6-19 and fixedly connected with the shooting frame assembly 6-9. Bottoms of the two shooting needle dials 6-17 are longitudinally provided with a row of shooting needles 6-18. Two rows of shooting needles 6-18 are gradually reduced in transverse distance from a feed direction to a discharge direction. The two rows of shooting needles 6-18 horizontally opposed to each other, and each horizontally opposed group of the two rows of shooting needles 6-18 extends into a gap between two adjacent groups of roller assemblies 6-102 to realize collapsing the shooting.

The bamboo fiber bundle directional stretching machine according to an embodiment further includes a humidifier or a sprayer (not shown in the figure). In the usage of the humidifier, the humidifier is arranged at the bottom of the discharge conveying assembly 6-103 to humidify the fiber bundle on the top of the belt 6-5. In the usage of the sprayer, the sprayer is hung on the top of the discharge conveying assembly 6-103 to spray and humidify the fiber bundle on the top of the belt 6-5. The humidifier or sprayer is arranged to adjust the humidity to obtain fiber bundle with different temperature and humidity specifications.

An operation principle of the bamboo fiber bundles directional stretching machine provided by the present disclosure is as follows. The formed bamboo fiber mat fed from the feed port is directionally stretched by the roller assemblies 6-102. During stretching, the shooting assembly 6-104 is driven by a motor and drives the eccentric wheel 6-12 to rotate. The eccentric wheel 6-12 drives the transmission connecting rod 6-13 to reciprocate upward and downward; and drives the stroke connecting rod 6-16 to reciprocate left and right. The stroke connecting rod 6-16 drives the slider 6-20 to slide along the guide rail 6-19, so as to drive the two shooting dials 6-17 to relatively reciprocate left and right. Through the trumpet shaped arrangement of the racking needles 6-18, the bamboo fiber mat is stretched and directionally shrinks. Then, the bamboo fiber mat is transported to the belt 6-5 after passing through the roller assembly 6-102, and the horizontal orientation of the continuous fiber mats is further realized through the fiber bundle collapsing mechanism 6-105.

In S7, the bamboo fiber bundle is twisted to form a bamboo fiber yarn.

Continuously oriented fiber bundle is wound, drawn, and twisted to form a fiber yarn with certain twist and diameter. A diameter range of the fiber yarn is 1.5-5 mm.

Specifically, fibers to be mixed may also be added, the bamboo fiber bundle and the fibers to be mixed are mixed and twisted to form a mixed fiber yarn. The fibers to be mixed may be other natural fibers and/or chemical fibers that meet the production requirements. The fibers to be mixed may include bamboo, kenaf, palm, cotton and/or silk fibers.

In S8, a rope is formed by the bamboo fiber yarn.

The fiber yarn twisted into yarns are plied and twisted to form the rope.

In S9, a spindle the bamboo fiber yarn or the rope is wound around based on the specifications.

The fiber yarn or fiber rope that has been wound into rolls is converted from a small roll to a large roll.

The method for preparing continuous bamboo fibers according to the present disclosure can also be used for preparing kenaf, palm or other fibers as required, or specific steps can be added or deleted as required, or the sequence of specific steps can be adjusted which all belong to the scope of protection of the present disclosure.

The principle and the embodiments of the present disclosure are explained by using specific examples in the present specification, and the above description of the embodiments is only used to help understand the method and the core idea of the present disclosure. Furthermore, for a person skilled in the art, according to the idea of the present disclosure, the specific embodiments and the application range may be changed. In summary, the description is not to be taken in a limiting sense.

LIST OF REFERENCE SYMBOLS

1-1 frame
1-2 loosening motor
1-3 bamboo green removing roller
1-4 bamboo green removing motor.
1-5 second rolling motor
1-6 rolling driving wheel
1-7 bamboo yellow removing motor
1-8 bamboo yellow removing driving wheel
1-9 first rolling motor
1-10 knot removing driving wheel
1-11 brush
1-12 knot removing roller
1-13 rolling rollers
1-14 bamboo yellow removing roller
1-15 bamboo green removing driving wheel
1-16 loosening roller
1-17 loosening driving wheel
2-1 frame
2-2 inlet driving roller
2-3 inlet pressing roller
2-4 first spring
2-5 cross beam
2-6 ruler
2-7 signal collector
2-8 optical probe
2-9 pillars
2-10 second spring
2-11 outlet pressing roller
2-12 test pressing wheel
2-13 outlet driving roller
2-14 movable guide wheel
2-15 hand wheel
2-16 adjustment platform
2-17 fixed guide wheel
2-18 handle
2-19 sloping plate
2-20 conveying roller
2-21 moving sheet
6-1 upper roller
6-2 lower roller
6-3 roller driving motor
6-4 first belt roller
6-5 belt
6-6 second belt roller
6-7 pressing roller
6-8 collapsing plates
6-9 shooting frame assembly
6-10 shooting driving motor
6-11 shooting bracket
6-12 eccentric wheel
6-13 transmission connecting rod
6-14 guide tube
6-15 linear guide rail sub-assembly
6-16 stroke connecting rod
6-17 shooting needle dials
6-18 shooting needle
6-19 guide rail
6-20 slider
6-101 frame assembly
6-102 roller assembly
6-103 discharge conveying assembly
6-104 shooting assembly
6-105 fiber bundle collapsing mechanism.

What is claimed is:

1. A method for preparing continuous bamboo fibers, the method comprising:

processing bamboo raw materials into bamboo fiber strips to form preliminary differentiated bamboo fibers;

screening, by a bamboo unit quality evaluation device according to an optical classification or a mechanical flexural modulus, the bamboo fiber strips, and separating the bamboo fiber strips with different properties according to product requirements;

performing high pressure splitting on the bamboo fiber strips which conform to a screening condition, to separate and form bamboo fibers and provide bamboo fiber raw materials for subsequent bamboo fiber products;

separating the bamboo fibers with different slenderness ratios from the bamboo fiber strips after the high pressure splitting is performed;

forming a partial oriented bamboo fiber mat with uniform density by the bamboo fibers;

forming an oriented bamboo fiber bundle with uniform linear density by the bamboo fiber mat;

twisting the oriented bamboo fiber bundle to form a bamboo fiber yarn;

forming a rope by the bamboo fiber yarn; and winding the bamboo fiber yarn or the rope around a spindle based on a specification, wherein:

the bamboo unit quality evaluation device includes a host machine and sorting frames, the host machine includes a frame, an inlet driving mechanism, a mechanical testing mechanism, and an outlet driving mechanism, all of which are arranged on the frame;

the inlet driving mechanism includes an inlet bracket, inlet pressing rollers, and inlet driving rollers, the inlet pressing rollers being moveably arranged on the inlet bracket, each of the inlet driving rollers being arranged directly below a corresponding one of the inlet pressing rollers, and a power connection being provided between the inlet driving rollers and a power source;

the outlet driving mechanism includes an outlet bracket, an outlet pressing roller, and an outlet driving roller, the outlet pressing roller being moveably arranged on the outlet bracket, the outlet driving roller being arranged directly below the outlet pressing roller, and a power connection being provided between the outlet driving roller and a power source;

a plurality of sorting frames are provided at an outlet side of the host machine along a straight line, and a power connection is provided between the inlet driving mechanism and a power source and between the outlet driving mechanism and the power source;

the mechanical testing mechanism includes two pillars arranged in parallel in a middle of the frame, a support plate being arranged on top of the two pillars, and a pressure sensor being arranged on the support plate;

a cross beam is slidably arranged between the two pillars, and two test pressing wheels are arranged on the cross beam;

a guide assembly is arranged below each of the test pressing wheels; and each of the sorting frames includes a plurality of conveying rollers arranged on a support, a sloping plate being arranged on one side of the support, an optical probe and a moving sheet being arranged between the conveying rollers, the moving sheet being connected to pneumatic clamps, and the optical probe being electrically connected to the pneumatic clamps.

2. The method of claim 1, wherein in the processing of the bamboo raw materials, the bamboo fiber strips are reticulated bamboo fiber strips strips, which are processed by a reticulated bamboo fiber preparation unit.

3. The method of claim 2, wherein in the processing of the bamboo raw materials, three-year-old fresh neosinocalamus *affinis* is selected, and a cylindrical neosinocalamus *affinis* is cut into a plurality of sections by a machine, each of the plurality of sections of neosinocalamus *affinis* is cut into a plurality of pieces, each of the plurality of pieces of neosinocalamus *affinis* is processed to remove bamboo green and bamboo yellow by a high-efficiency reticulated bamboo fiber preparation machine, and rolled and loosened by smooth rollers and toothed rollers, and finally the reticulated bamboo fiber strips with specified length and width, criss-cross fibers and a thickness of 1-7 mm are formed.

4. The method of claim 1, wherein in the performance of high pressure splitting on the bamboo fiber strips, the bamboo fiber strips are twisted to form fibrous bamboo sheets with specified length and width and a thickness of 1-5 mm, which provide the bamboo fiber raw materials for the subsequent bamboo fiber products, and a temperature of the bamboo fiber strips is adjusted to 20-75 degrees centigrade and a humidity of the bamboo fiber strips is adjusted to 10-80%.

5. The method of claim 4, wherein in the separation of the bamboo fibers, the bamboo fiber raw materials with a thickness of 1-5 mm are defibrated, and impurities and scraps are removed, and the bamboo fiber raw materials are separated into fluffy flocculent bamboo fibers with different slenderness ratios.

6. The method of claim 5, wherein in the formation of the partial oriented bamboo fiber mat, the fluffy flocculent bamboo fibers are spread to form a continuous bamboo fiber mat with fibers distributed in a specified geometric shape, the continuous bamboo fiber mat having specified density, width and thickness.

7. The method of claim 6, wherein in the formation of the oriented bamboo fiber bundle, the fiber mat is stretched and oriented to form a continuous bamboo fiber bundle with specified width and thickness by a bamboo fiber bundles directional stretching machine, wherein length directions of fibers of the fiber mat are all distributed in a conveying direction of the fibers.

8. The method of claim 7, wherein in the twisting of the bamboo fiber bundle, the continuous bamboo fiber bundle is wound, drawn and twisted to form the bamboo fiber yarn with specified twist and diameter, and a diameter range of the bamboo fiber yarn is 1.5-5 mm.

9. The method of claim 8, wherein in the formation of the rope, the bamboo fiber yarn is plied and twisted to form the rope.

10. The method of claim 8, wherein in the twisting of the bamboo fiber bundle, fibers to be mixed are added, and the bamboo fiber bundle and the fibers to be mixed are mixed and twisted to form a mixed fiber yarn; the fibers to be mixed comprise natural fibers and/or chemical fibers.

11. The method of claim 2, wherein:

the reticulated bamboo fiber preparation machine comprises a frame, a knot removing roller assembly, a rolling roller assembly, a bamboo yellow removing roller assembly, a bamboo green removing roller assembly, and a loosening roller assembly, all of which are arranged on the frame;

the rolling roller assembly comprises a first rolling roller assembly, a second rolling roller assembly, a third rolling roller assembly, a fourth rolling roller assembly and a fifth rolling roller assembly;

the bamboo green removing roller assembly comprises a first bamboo green removing roller assembly and a second bamboo green removing roller assembly;

the knot removing roller assembly, the first rolling roller assembly, the second rolling roller assembly, the bamboo yellow removing roller assembly, the third rolling roller assembly, the first bamboo green removing roller assembly, the fourth rolling roller assembly, the second bamboo green removing roller assembly, the loosening roller assembly, and the fifth rolling roller assembly are arranged on the frame in sequence from a feed end to a discharge end;

the knot removing roller assembly comprises a knot removing roller and a knot removing driving wheel, the knot removing roller is arranged directly above the knot removing driving wheel, and a power connection is provided between the knot removing driving wheel and a rolling motor;

the rolling roller assembly comprises a rolling roller and a rolling driving wheel, and the rolling roller is arranged directly above the rolling driving wheel;

the bamboo yellow removing roller assembly comprises a bamboo yellow removing roller and a bamboo yellow removing driving wheel, the bamboo yellow removing roller is arranged directly above the bamboo yellow removing driving wheel, a power connection is provided between the bamboo yellow removing roller and a bamboo yellow removing motor;

a power connection is provided between the bamboo yellow removing driving wheel and the rolling motor;

a plurality of scrapers are uniformly arranged on the bamboo yellow removing roller in a circumferential direction;

each of the first bamboo green removing roller assembly and the second bamboo green removing roller assembly comprises a bamboo green removing roller and a bamboo green removing driving wheel, the bamboo green removing roller being arranged directly below the bamboo green removing driving wheel, a power connection being provided between the bamboo green removing roller and the rolling motor, and a power connection being provided between the bamboo green removing driving wheel and a bamboo green removing motor;

a plurality of scrapers are uniformly arranged on the bamboo green removing roller;

the loosening roller assembly comprises a loosening roller and a loosening driving wheel;

the loosening roller is arranged directly above the loosening driving wheel; and a power connection is provided between the loosening driving wheel and a loosening motor.

* * * * *